US006710275B2

(12) United States Patent
Sunadome

(10) Patent No.: US 6,710,275 B2
(45) Date of Patent: Mar. 23, 2004

(54) PUSH BUTTON STRUCTURE

(75) Inventor: Minoru Sunadome, Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/452,122

(22) Filed: Jun. 3, 2003

(65) Prior Publication Data

US 2003/0221940 A1 Dec. 4, 2003

(30) Foreign Application Priority Data

Jun. 3, 2002 (JP) ..... P 2002-161117

(51) Int. Cl.[7] ..... H01H 13/705; H01H 3/12
(52) U.S. Cl. ..... 200/341; 200/343; 200/345
(58) Field of Search ..... 200/341–345, 200/520–536; 361/679–684; 400/495, 496

(56) References Cited

U.S. PATENT DOCUMENTS 4,613,736 A * 9/1986 Shichijo et al. ..... 200/341
4,997,998 A * 3/1991 Bauer ..... 200/345
5,749,457 A * 5/1998 Castaneda et al. ..... 200/343
6,027,267 A * 2/2000 Yokobori ..... 200/343

* cited by examiner

*Primary Examiner*—James R. Scott
(74) *Attorney, Agent, or Firm*—Sughrue Mion, PLLC

(57) ABSTRACT

A push button structure has an outer face of a key top that extends from a top face to a seat portion. An outer face starting from the top face and terminating at a position between the top face and the seat portion is tapered in a spreading direction. An outer face that extends from the position between the top face and the seat portion toward the seat portion is formed so as not to approach the outer face of the adjacent key top. In the outer face of the key top, an inward step is disposed at the position between the top face and the seat portion. The starting end of the outer face extending toward the seat portion is shifted to the inner side from the terminating end of the outer face starting from the top face of the key top.

4 Claims, 9 Drawing Sheets

PUSH BUTTON STRUCTURE

The present disclosure relates to the subject matter contained in Japanese Patent Application No. 2002-161117 filed Jun. 3, 2002, which is incorporated herein by reference in its entirety.

BACKGROUND OF THE INVENTION

1. Field of the Invention

The present invention relates to a push button structure having a plurality of push buttons which are disposed in an operation panel to be adjacent to each other, and which are depressed in the thickness direction of the operation panel.

2. Description of the Related Art

Conventionally, as shown in FIG. 8, a plurality of operational push buttons 52 are adjacently juxtaposed on an operation panel 51 of an electrical apparatus such as a car stereo 50. FIG. 9 shows main portions of the appearance of the push buttons 52.

FIG. 10 shows a section taken along X—X in FIG. 9. As shown in FIG. 10, each of the push buttons 52 has a key top 53 which has an inverted U-shape, and which protrudes from the operation panel 51 in the upward direction (in FIG. 8, the forward direction). A fulcrum 54 is disposed in front of the key top 53, and a press portion 55 is disposed in rear of the key top 53.

As shown in FIG. 11, in order to facilitate drawing of molds after a process of molding the push button 52, the key top 53 of an inverted U-shape is tapered so as to spread as advancing from a top face 57 to a seat portion 58.

FIG. 12A shows the push button 52 which is not depressed, and FIG. 12B shows the push button 52 which is depressed. As shown in FIG. 12B, when the top face 57 of the key top 53 is pushed in the thickness direction (the lateral direction in FIG. 12B), the push button 52 swings in the lateral direction in FIG. 12B about the fulcrum 54.

As a result, the press portion 55 which is disposed at the rear of the key top 53 pushes a switch 56 to perform an input operation.

An electrical apparatus such as the car stereo 50, which requires a limited installation space, must be miniaturized.

In order to realize miniaturization, the operation panel 51 must be reduced in size. However, the size of the plurality of push buttons 52 which are arranged on the operation panel 51 cannot be reduced beyond a certain limit because the area of the top face 57 must be ensured from a viewpoint of operability.

Therefore, it has been necessary to reduce the lateral gap between the push buttons 52. FIG. 13 is a sectional view taken along XIII—XIII in FIG. 9.

As shown in FIG. 13, a side face 59 of the key top 53 on the side of an adjacent push button is inclined so as to spread as advancing from the top face 57 to the seat portion 58. When the lateral gap a between the push buttons 52 is reduced, therefore, the seat portions 58 interfere with each other, thereby causing a problem in that the operability is impaired.

It may be contemplated that the height b of each push button 52 shown in FIG. 13 is reduced to suppress the spreading amount of the side faces of the key top 53, so that the distance between the adjacent push buttons 52 is shortened. In this case, however, there is a problem in that it is difficult to ensure a sufficient stroke in the push buttons 52.

SUMMARY OF THE INVENTION

The invention has been devised in view of the above problems. It is an object of the invention to provide a push button structure in which a gap between push buttons can be reduced without lowering the operability of the push buttons, so that the structure can be made compact.

In order to attain the object, a first aspect of the invention provides a push button structure having: a plurality of push buttons which are disposed in an operation panel to be adjacent to each other and which are to be depressed in a thickness direction of the operation panel, wherein each of the push buttons comprises a key top having a plurality of side walls, a top face and a seat portion, and among the side walls of the key top, a portion of a side wall on a side of an adjacent push button is formed not to approach the adjacent push button, the portion extending from a position between the top face and the seat portion toward the seat portion.

Push buttons to which the invention can be applied include those which are to be depressed in the thickness direction, and in each of which, for manufacturing reasons, the key top has a sectional shape that spreads as advancing from a top face functioning as a press face to a seat portion. Therefore, the gap between adjacent push buttons is usually limited by the size of the seat portion. In the specification, the term "adjacent" means adjacency in the lateral direction of the operation panel, and does not mean adjacency in the vertical direction of the operation panel.

In the thus configured push button structure, the outer face of the side wall of the key top which extends from the side of the top face to that of the seat portion is tapered in a spreading direction in a portion starting from the top face and terminating at the position between the top face and the seat portion. By contrast, the portion of the outer face starting from that position and terminating in the seat portion is not tapered in a spreading direction so as not to approach an outer face of the adjacent key top.

Consequently, the gap between adjacent push buttons is limited by the size of the key top at the position between the top face and the seat portion, so that each push button can further approach the adjacent push button as compared with the conventional case where the gap is determined by the size of the seat portion. As a result, the push button structure can be made compact.

According to a second aspect of the invention, an outer face in the portion extending from the position between the top face and the seat portion toward the seat portion is inclined to a side which is opposite to the adjacent push button, as advancing toward the seat portion.

In the outer face of the key top of the push button, the portion beyond the position between the top face and the seat portion is formed so as not to approach the outer face of the adjacent key top. From a manufacturing viewpoint, the inner face of the key top is preferably tapered so as to spread as advancing from the rear face of the top face to the seat portion.

In the thus configured push button structure, the gap between the push button and the adjacent one is increased in a portion of the outer face of the key top beyond the position between the top face and the seat portion. Therefore, the push buttons can further approach each other, and the push button structure can be made compact.

According to a third aspect of the invention, a step which is bent toward a center of the key top is disposed at the position between the top face and the seat portion of the outer face, thereby placing a starting end of the outer face extending from the position between the top face and the seat portion toward the seat portion, to be closer to the center of the key top than a terminating end of the outer face extending from the top face to the position between the top face and the seat portion.

In the thus configured push button structure, the position of the starting end of the outer face extending from the position between the top face and the seat portion toward the seat portion is shifted toward the center from the position of the terminating end of the outer face extending from the top face of the key top to the position between the top face and the seat portion. In a process of manufacturing the push button, therefore, the terminating and starting positions are not required to coincide with each other, so that the manufacturing process can be simplified.

Since the outer face portion of the key top extending from the position between the top face and the seat portion toward the seat portion is closer to the center, the adjacent push buttons can be placed closer to each other, with the result that the push button structure can be made compact.

DETAILED DESCRIPTION OF THE PREFFERED EMBODIMENTS

Figure 1:
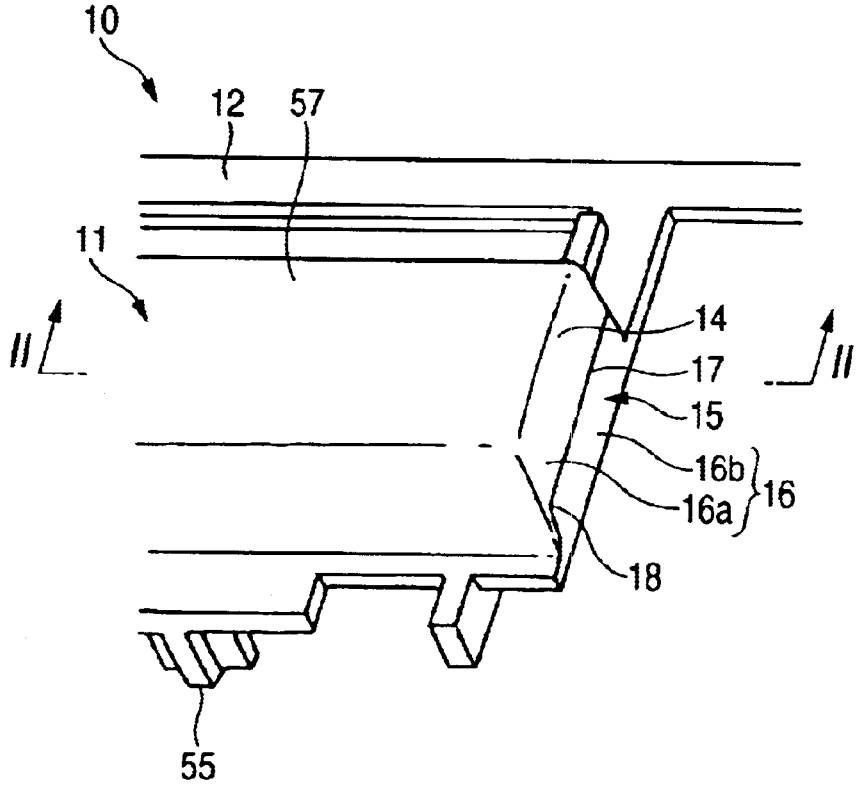
FIG. 1 is a perspective view showing an embodiment of the push button structure of the invention.

Hereinafter, embodiments of the push button structure of the invention will be described in detail with reference to the accompanying drawings. In the following description of the embodiments, the components which have been described with reference to FIGS. 8 to 13 are denoted by the same reference numerals in the figures, and their description is simplified or omitted.

Figure 4:
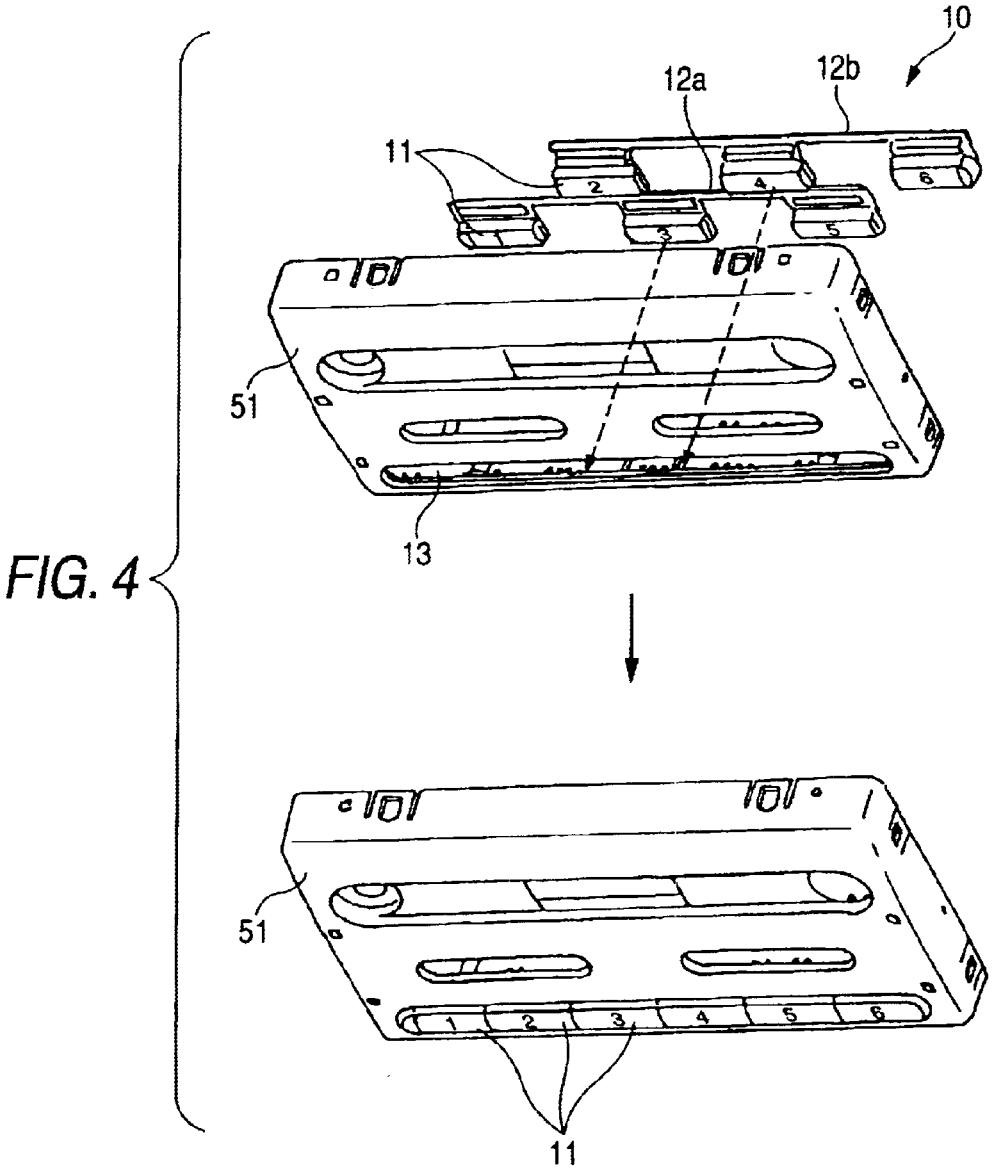
FIG. 4 is an overall view of an operation panel using a push button structure which is the embodiment of the invention.

As shown in FIG. 4, a push button structure 10 which is an embodiment of the invention is disposed inside the operation panel 51. Push buttons 11 are swingably attached to support members 12*a* and 12*b* so that adjacent push buttons 11 are attached to different support members. In the embodiment, the push buttons are classified into two groups. The term "adjacent" means adjacency in the lateral direction in FIG. 4, and, even in the case where the push buttons 11 are arranged in a plurality of rows which are vertically juxtaposed, vertical adjacency is ignored.

When the push buttons 11 of the two groups are fitted from the rear side into a push button opening 13 of the operation panel 51 so as to protrude to the front, therefore, the plurality of push buttons 11 are arranged with being exposed from the front face of the operation panel 51. Since the push buttons 11 are supported by the respective support members 12*a* and 12*b* so as to be immovable in the lateral direction in FIG. 4, it is not necessary to dispose a frame between the adjacent push buttons 11, whereby the gap between the push buttons 11 can be reduced, so that the operation panel 51 can be made compact.

Figure 2:
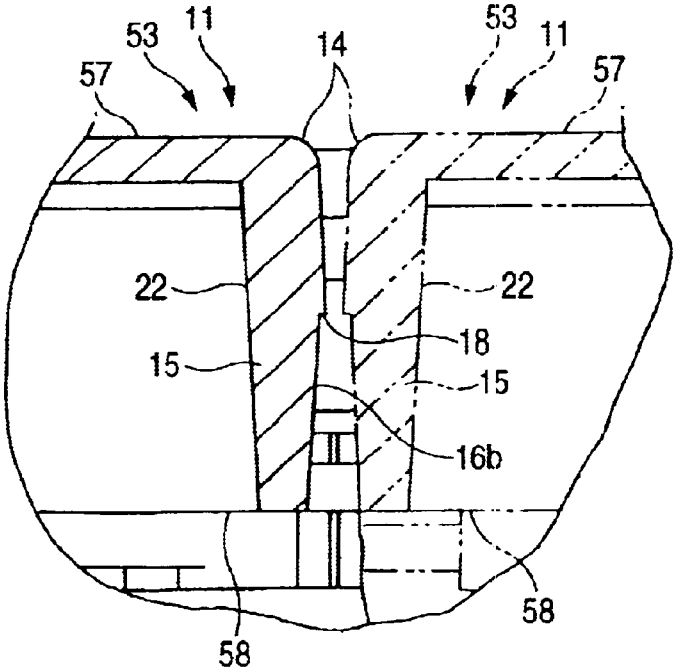
FIG. 2 is a sectional view of a push button taken along II—II in FIG. 1.

FIG. 1 shows the appearance of the push button 11. FIG. 2 shows a sectional shape of the push button 11 taken along II—II in FIG. 1. The whole of the push button 11 has an inverted U-shape. In the outer side of the key top 53, a side wall 15 is disposed which starts from the top face 57 to be depressed by a finger and extends toward the seat portion 58 via a rounded portion 14. In an outer face 16 of the side wall 15, an outer face 16*a* which extends to an intermediate position 17 spreads laterally.

Figure 3:
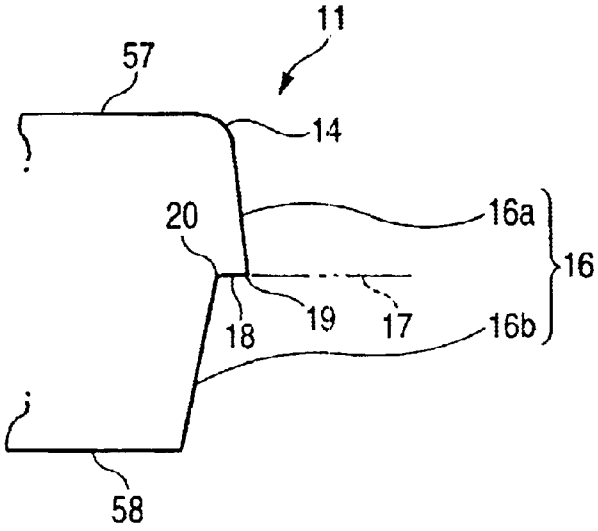
FIG. 3 is an enlarged view of a step portion.

Referring also to FIG. 3, a step 18 which is bent toward the center of the key top 53 is disposed at the intermediate position 17 in the outer face 16 of the key top 53, and the terminating end 19 of the outer face 16*a* of the key top 53 which extends from the top face 57 to the intermediate position 17 is positioned in the outer edge of the step 18.

By contrast, in the outer face 16 of the side wall 15 of the key top 53, an outer face 16*b* which extends from the intermediate position 17 toward the seat portion 58 is formed into a shape which does not spread at least toward the outer side, thereby preventing the side wall from approaching the adjacent push button 11.

Figure 5:
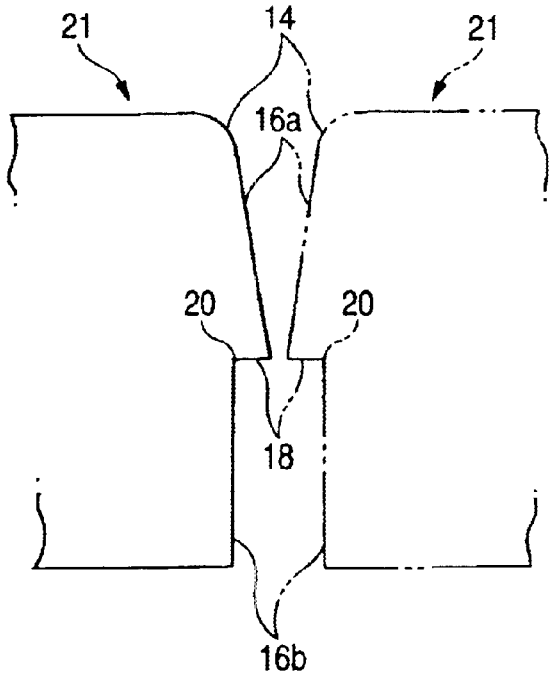
FIG. 5 is a diagram illustrating another embodiment.

Specifically, the starting end 20 of the outer face 16*b* which extends from the intermediate position 17 toward the seat portion 58 is positioned in the inner edge of the step 18. Preferably, the outer face is tapered so as to be inclined to the inner side of the key top 53 as advancing from the starting end 20 toward the seat portion 58. Alternatively, as in a push button 21 shown in FIG. 5, the outer face 16*b* may extend straight downward from the starting end 20 toward the seat portion 58.

As shown in FIG. 2, the inner face 22 of the push button 11 is tapered so as to uniformly spread as advancing from the inside of the top face 57 to the seat portion 58.

In the above-described push button structure 10, the outer face 16*a* of the side wall 15 of the key top 53 which extends from the top face 57 toward the seat portion 58 is tapered in a spreading direction in the portion starting from the top face 57 and terminating at the intermediate position 17.

By contrast, the outer face 16*b* which extends from the intermediate position 17 to the seat portion 58 is formed so as not to approach the outer face 16*b* of the adjacent key top 53. Therefore, the gap between the adjacent push buttons 11 is determined by the size of the key top 53 at the intermediate position 17, so that the push button can further approach the adjacent push button 11 as compared with the conventional case where the gap is determined by the size of the seat portion 58. As a result, the push button structure 10 can be made compact.

Figure 7:
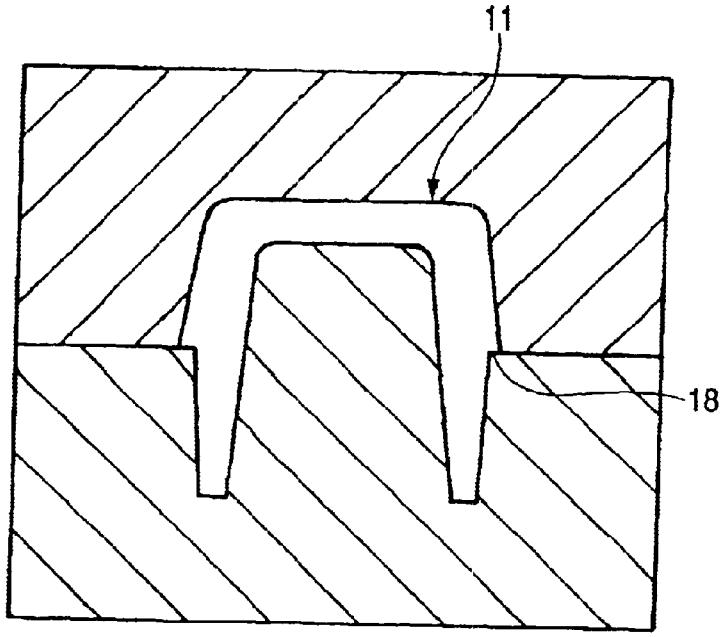
FIG. 7 is a sectional view showing a fitted state of molds in a process of molding a push button.
Figure 8:
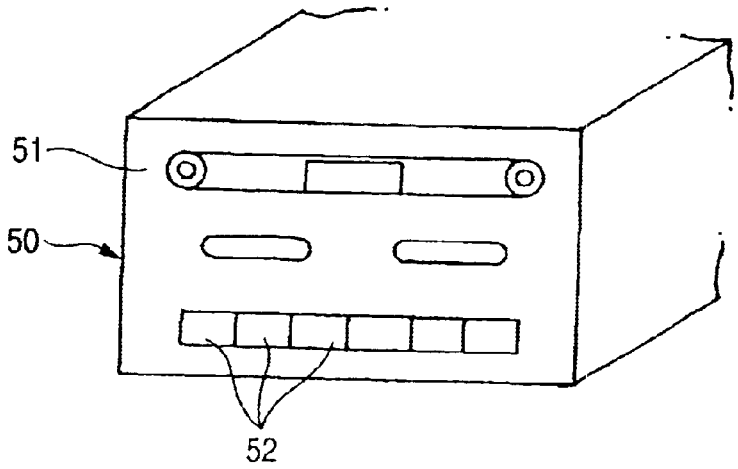
FIG. 8 is a perspective view showing a car stereo that is a conventional example in which a push button structure is used.
Figure 9:
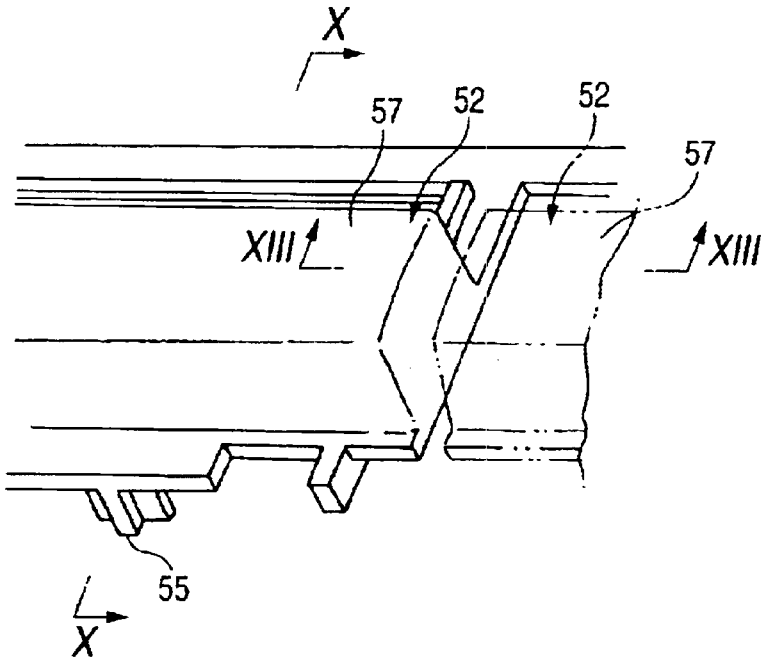
FIG. 9 is an external view of a push button.
Figure 10:
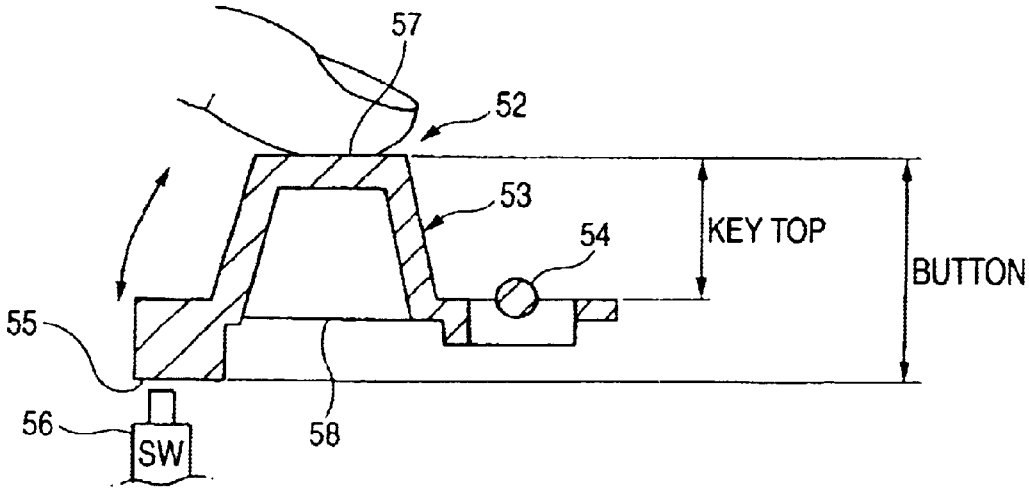
FIG. 10 is a sectional view taken along X—X in FIG. 9.
Figure 11:
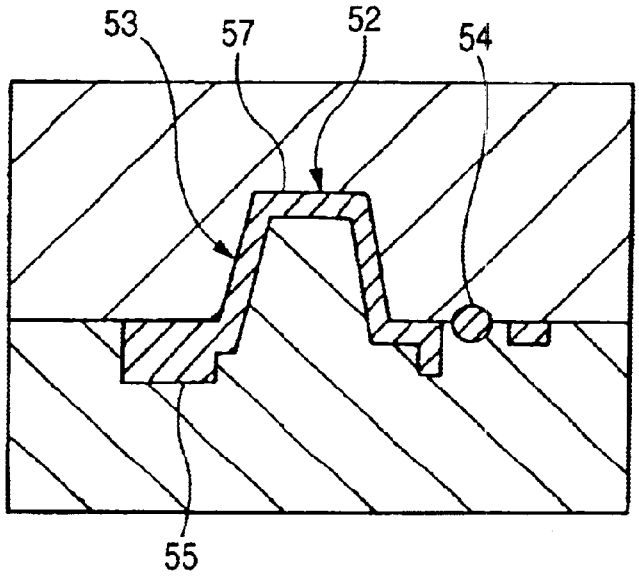
FIG. 11 is a sectional view showing a fitted state of molds in a process of molding a push button.
Figure 12B:
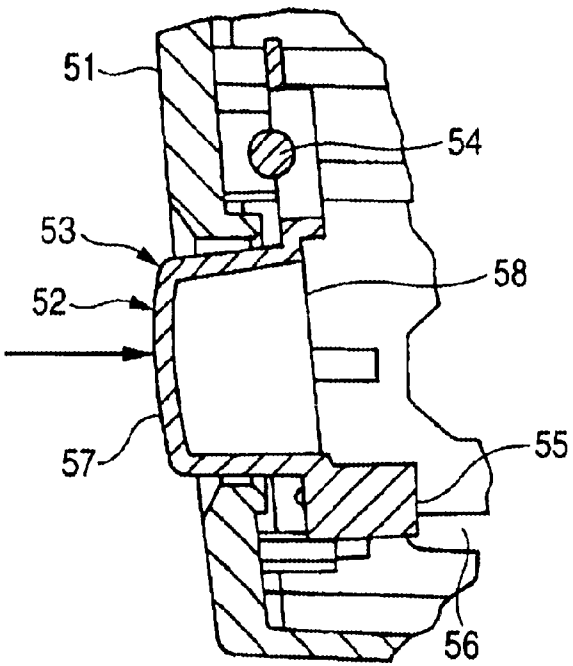
FIG. 12B is a sectional view showing the push button which is depressed.
Figure 12A:
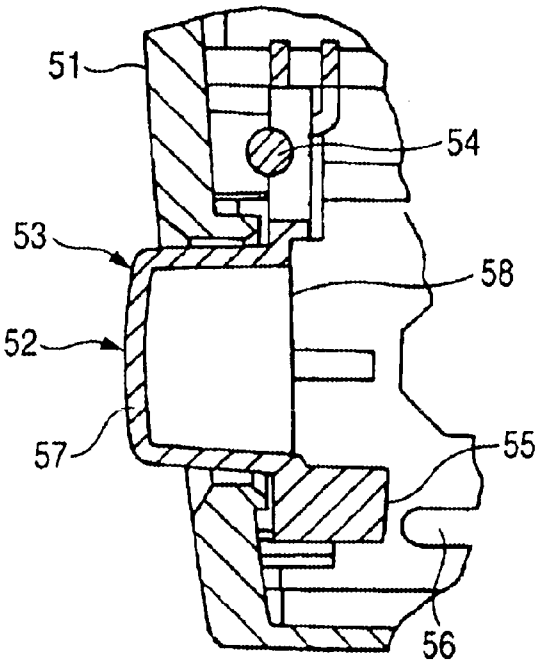
FIG. 12A is a sectional view showing a push button which is not depressed.
Figure 13:
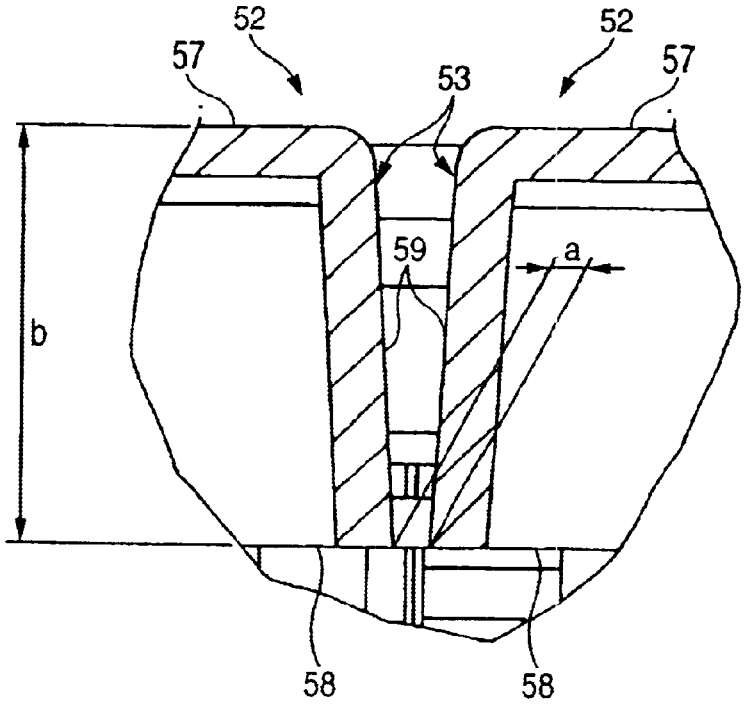
FIG. 13 is a sectional view taken along XIII—XIII in FIG. 9.

As shown in FIG. 7, the fitting position of molds in the process of manufacturing the push button 11 can be set to coincide with the position of the step 18. Therefore, the push button 11 of a desired sectional shape can be manufactured even when some manufacturing error occurs. The step 18 is required only to be directed toward the inside of the key top 53, and the length of the step 18 is not particularly restricted.

The push button structure 10 of the invention is not limited to the above-described embodiments, and may be adequately modified or improved.

Figure 6:
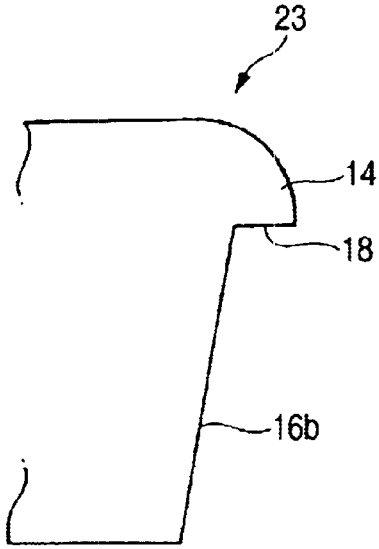
FIG. 6 is a diagram illustrating a further embodiment.

In the above-described embodiments, the intermediate position 17 of the outer face of the side wall 15 of the key top 53 is placed in the vicinity of the middle in the height direction. Alternatively, as a push button 23 shown in FIG. 6, the intermediate position 17 may be placed in succession to the rounded portion 14 continuous to the top face 57. In this case, the outer face 16 of the key top 53 is tapered toward the inside of the key top 53 with starting from the rounded portion 14.

As described above, in the push button structure of the invention, the outer face of the side wall of the key top which extends from the side of the top face to that of the seat portion is tapered in a spreading direction in a portion starting from the top face and terminating at the intermediate position. By contrast, the portion of the outer face which starts from the intermediate position and terminates in the seat portion is not tapered in a spreading direction so as not to approach the outer face of the adjacent key top. Therefore, the gap between adjacent push buttons is limited by the size of the key top at the intermediate position, so that each push button can further approach the adjacent push button as compared with the conventional case where the gap is determined by the size of the seat portion. As a result, the push button structure can be made compact.

What is claimed is:

1. A push button structure comprising:

a plurality of push buttons which are disposed in an operation panel to be adjacent to each other and which are to be depressed in a thickness direction of the operation panel, wherein each of the push buttons comprises a key top having a plurality of side walls, a top face and a seat portion, and among the side walls of the key top, a portion of a side wall on a side of an adjacent push button is formed not to approach the adjacent push button, the portion extending from a position between the top face and the seat portion toward the seat portion.

2. A push button structure according to claim 1, wherein an outer face in the portion extending from the position between the top face and the seat portion toward the seat portion is inclined to a side which is opposite to the adjacent push button, as advancing toward the seat portion.

3. A push button structure according to claim 1, wherein a step which is bent toward a center of the key top is disposed at the position between the top face and the seat portion of the outer face, thereby placing a starting end of the outer face extending from the position between the top face and the seat portion toward the seat portion, to be closer to the center of the key top than a terminating end of the outer face extending from the top face to the position between the top face and the seat portion.

4. A push button structure according to claim 2, wherein a step which is bent toward a center of the key top is disposed at the position between the top face and the seat portion of the outer face, thereby placing a starting end of the outer face extending from the position between the top face and the seat portion toward the seat portion, to be closer to the center of the key top than a terminating end of the outer face extending from the top face to the position between the top face and the seat portion.

* * * * *